US009777435B2

(12) United States Patent
Zhou et al.

(10) Patent No.: US 9,777,435 B2
(45) Date of Patent: Oct. 3, 2017

(54) PRINTING SUBSTRATE

(71) Applicant: Hewlett-Packard Development Company, L.P., Houston, TX (US)

(72) Inventors: Xiaoqi Zhou, San Diego, CA (US); Xulong Fu, San Diego, CA (US); Paul C. Landrum, San Diego, CA (US); Francois K. Pirayesh, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/322,870

(22) PCT Filed: Jul. 31, 2014

(86) PCT No.: PCT/US2014/049123

§ 371 (c)(1),
(2) Date: Dec. 29, 2016

(87) PCT Pub. No.: WO2016/018360

PCT Pub. Date: Feb. 4, 2016

(65) Prior Publication Data

US 2017/0145636 A1 May 25, 2017

(51) Int. Cl.

| | |
|---|---|
| ***D21H 17/63*** | (2006.01) |
| ***D21H 17/37*** | (2006.01) |
| ***D21H 17/36*** | (2006.01) |
| ***D21H 21/52*** | (2006.01) |
| ***D21H 17/67*** | (2006.01) |
| ***D21H 15/06*** | (2006.01) |

(52) U.S. Cl.

CPC ..... *D21H 17/63* (2013.01); *D21H 15/06* (2013.01); *D21H 17/36* (2013.01); *D21H 17/37* (2013.01); *D21H 17/67* (2013.01); *D21H 17/675* (2013.01); *D21H 21/52* (2013.01)

(58) Field of Classification Search

CPC ..... D21H 17/67; D21H 17/675; D21H 15/06
See application file for complete search history.

(56) References Cited

U.S. PATENT DOCUMENTS

| | | | | |
|---|---|---|---|---|
| 4,489,188 | A | 12/1984 | Jones et al. | |
| 5,236,987 | A | 8/1993 | Arendt | |
| 5,302,404 | A | 4/1994 | Rissanen et al. | |
| 5,441,784 | A | 8/1995 | Smith | |
| 5,714,270 | A | 2/1998 | Malhotra et al. | |
| 6,440,269 | B1 | 8/2002 | Freeburn | |
| 7,696,262 | B2 | 4/2010 | Cagle et al. | |
| 8,221,895 | B2 | 7/2012 | Wicher | |
| 2001/0021453 | A1* | 9/2001 | Hansen | A61F 13/0209 428/407 |
| 2002/0104634 | A1* | 8/2002 | Glittenberg | C08L 3/06 162/175 |
| 2006/0115633 | A1 | 6/2006 | Steichen et al. | |
| 2006/0260775 | A1* | 11/2006 | Sammarco | D21H 17/67 162/141 |
| 2007/0218796 | A1 | 9/2007 | Yao | |
| 2012/0012264 | A1 | 1/2012 | Zhou et al. | |

FOREIGN PATENT DOCUMENTS

| | | |
|---|---|---|
| EP | 0764547 | 3/1997 |
| EP | 2050784 | 4/2009 |
| JP | H04153391 | 5/1992 |
| WO | WO 2012/134455 | 10/2012 |
| WO | WO-2013186367 | 12/2013 |
| WO | WO 2014/098878 | 6/2014 |

OTHER PUBLICATIONS

International Search Report and Written Opinion for International Application No. PCT/US2014/049123 dated Apr. 28, 2015, 12 pages.

* cited by examiner

*Primary Examiner* — Betelhem Shewareged
(74) *Attorney, Agent, or Firm* — HP Inc. Patent Department

(57) ABSTRACT

A printing substrate comprising fibers from wooded resource that have more than 5% of fines fibers with an average length that is less than 0.1 mm; more than about 10 wt % of, at least, a polymeric substance; and between 0.1 wt % and 40 wt % of particulate inorganic substances having an average particle size between 0.1 and 2.0 m. Also disclosed herein a method for making such printing substrate and a method for producing printed images using said printing substrate.

20 Claims, 1 Drawing Sheet

PRINTING SUBSTRATE

BACKGROUND

Inkjet printing technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of medium substrates. Inkjet printing technology has found various applications on different substrates including, for examples, cellulose paper, metal, plastic, fabric, and the like. The substrate plays a key role in the overall image quality and permanence of the printed images.

Large format print medium becomes more and more popular and finds use in many applications such as wall coverings, banners, and signs of many types that can be printed to create images with one or more symbols, text and photographs. When printing on such substrates, challenges exist due to their specific nature. Durability of the image printed thereon is often in consideration. Accordingly, investigations continue into developing medium substrates that can be effectively used for large format printing which can be used a wall covering substrate, for examples, and which can impart good image quality, good mechanical resistance and other prominent performances.

BRIEF DESCRIPTION OF THE DRAWING

The drawings illustrate various embodiments of the present printable medium and are part of the specification.

DETAILED DESCRIPTION

Figure 1:
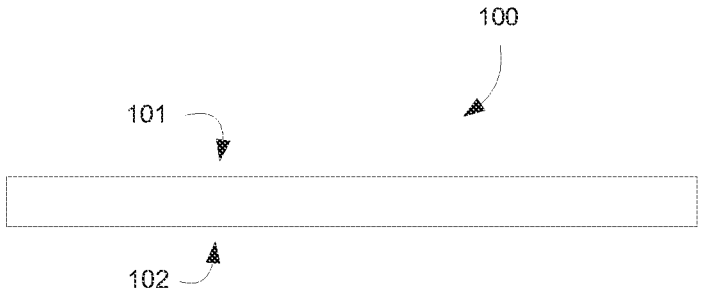
FIGS. 1 and 2 are cross-sectional views of the printable medium according to embodiments of the present disclosure.

The present disclosure refers to a printing substrate comprising fibers from wooded resource that have more than 5% of fiber fines with an average length that is less than 0.1 mm; more than about 10 wt % of, at least, a polymeric substance; and between 0.1 wt % and 40 wt % of particulate inorganic substances having an average particle size between 0.1 and 2.0 μm. The present disclosure also refers to a method for making such printing substrate and to a method for producing printed images using said printing substrate.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some examples, the printing substrate or printable medium is a media that can be used directly on printer and that can be printed thereon, meaning therefore that the printing substrate described herein could be used as a printing media. The printing substrate can be an inkjet printable medium. The substrate can thus be specifically designed to receive any inkjet printable ink, such as, for example, organic solvent-based inkjet inks or aqueous-based inkjet inks Examples of inkjet inks that may be deposited, established, or otherwise printed on the printable substrate, include pigment-based inkjet inks, dye-based inkjet inks, pigmented latex-based inkjet inks and UV curable inkjet inks.

In some other examples, the printing substrate can be considered as a substrate for printable media, meaning therefore that one layer or multiple coating layers, referring as the "image receiving layer" or "ink receiving coating", for example, could be applied to the surface of the substrate in order to produce a printable media. The word "supporting" refers herein to a substrate where the printing image can be formed on at least one side of the substrate, i.e. the image side, via an image receiving layer deposited on the surface of the substrate. The word "supporting" also refers to a physical objective of the substrate which is to carry the image with any desired geometry and size with excellent durability or mechanical strength. In addition, when used as printing substrate, other functional coating layers can be applied on top of the substrate such as mechanical durability enhance layer, gloss control layer and fire resistance control layer. Furthermore, the printing substrate can be made into a textured surface. Such a surface can be made from mechanical method like embossing and chemical method like acid washing.

In some examples, the printing substrate is a composite printing substrate (or composite supporting substrate or composite structure). The word "composite" refers herein to a material made from at least two constituent materials, or layers, that have different physical and/or chemical properties from one another, and wherein these constituent materials/layers remain separate at a molecular level and distinct within the structure of the composite. The printing substrate includes indeed a dispersed phase that forms multiple domains inside composite structure. In some examples, the printing substrate includes a dispersed phase that contain fiber fines from wooded resources and particulate inorganic substances, and includes at least a polymeric substance or a polymeric system comprising at least two different polymeric substances. In some other examples, the composite printing substrate is a laminated structure. The "laminated", as used herein, reflect the fact that the layers or compounds have been applied to each other using a lamination process. Such laminated structure is specifically present when the printing substrate supports a wall covering or when applied or attached to a surface or wall.

The printing substrate, as disclosed herein, can be used as a wall covering material (e.g., wallpaper) for home or commercial use, for decoration or display as well as signs or banners and the like. In some examples, the printable substrate of the present disclosure is a wall covering substrate. The substrate includes layers that form a non-image side and an image side on the printable medium. The non-image side, or backside, is the side that would face and attach to a wall, in a wall covering application, or even in a sign or banner application having a single image side. The image side is the side that includes material layers to receive, support and protect an image. The term "wall covering," as used herein, means a print medium that supports various imaging materials and applications, for example, various types of inkjet inks and inkjet printing, for image formation, including digital printing for wall decoration. In addition, the term "wall covering" means a product that complies with federal and industry standards or specifications for wall coverings including, but may not be limited to, CCC-W-408A and D, ASTM F793 and CFFAW-101D. Under these standards, wall coverings have weight and durability requirements depending on which category or type that the wall covering falls within. Category I is for decorative only wall covering, while Category VI is for commercial serviceability wall covering. (Types I, II and III wall coverings are substantially equivalent to Categories, IV, V and VI, respectively, among the standards). The wall covering according to the principles described herein has wear and tear durability of Category V, Type-II, or possibly higher grade, wall coverings in accordance with the aforementioned standards and may meet or exceed established criteria for Type-II wall coverings under the aforementioned standards. By "wear and tear", it is meant the minimum scrubbability standard and the minimum breaking strength standard, respectively, of ASTM F793. Herein, the term "wall covering," "wall covering print medium," and "wall covering digital print medium" may be used interchangeably.

The printing substrate of the present disclosure, when used in a wall covering application, have a durability that may meet or exceed Type-II wall covering standards or specifications identified herein. In addition, the printable substrate of the present disclosure is able to provide a durable Type-II wall covering and is also free of polyvinyl chloride (PVC), which is harmful to the environment. In some examples, the printable substrate, when used a wall covering in an in-door environmental, is able to meet "Fire Resistance or flame resistance" standards such as ASTM E84 for example.

The printing substrate has a fast absorption rate. The resulting printed article and image have, therefore, outstanding print quality. By "fast absorption rate", it is meant that the water, solvent and/or vehicle of the ink can be absorbed by the substrate at a fast rate so that the ink composition does not have a chance to interact and cause bleed and/or coalescence issues. The absorption rate, that is responsible for defects-free printing, is also dependent on the speed of the printing and amount of ink being used. The faster the printing speed and the higher the amount of ink used, the higher is the demand on faster absorption from the media. A good diagnostic plot with maximum ink loading, such as in the case of secondary colors, would be prone to coalescence and a pattern of lines of the primary and secondary colors passing through area fill of primary and secondary colors would be prone to bleed. If no bleed or coalescence is present at the desired printing speed and ink loading, the absorption rate of the printing media would be sufficient. Bristow wheel measurements can be used for a quantitative measure of absorption on media wherein a fixed amount of an ink fluid is applied through a slit to a strip of media that moves at varying speeds. In some examples, the printing substrate has an ink absorption rate that is not less than 30 $ml/m^2 \times sec^{1/2}$, as measured by Bristow wheel ink absorption method. (The Bristow wheel is an apparatus also called the Paprican Dynamic Sorption Tester, model LBA92, manufactured by Op Test Equipment Inc.)

In some examples, the printing substrate is a durable and flexible support. By "durable", it is meant that the supporting substrate has a high tolerance to certain physical forces and surface degradation forces. The durability of the supporting substrate is manifested according to one or more of tear and tensile strength, surface abrasion, water and solvent resistance, fire resistance, dimensional stability, stain resistance, heat ageing, cold climate, and others described in the wall covering classification standards ASTM F793 and Federal Specification CCC-W-408D, for example, for Type II commercial serviceability wall coverings. The printing substrate may be substantially flexible. By "flexible", it is meant pliant or pliable and able to be rolled and unrolled without breaking or cracking, for example.

In some examples, the printing substrate has a surface smoothness that is less than 150 Sheffield smoothness unites. In some other examples, the printing substrate has a surface smoothness that is less than 100 Sheffield smoothness unite. In yet some other examples, the printing substrate has a surface smoothness that ranges between from about 30 to about 90 Sheffield smoothness unite. The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit).

In some examples, the printing substrate, when used in a wall covering application, exhibits a ratio of machine direction (MD) tensile stiffness to cross direction (CD) tensile stiffness of less than 2.5; or the MD/CD tensile stiffness ratio may be less than 1.5. In some examples, the printing substrate has a machine direction (MD) tensile stiffness, measured using an Intron device available from Testing Machines, Inc. (Newcastle, Del.), that is greater than 25 lbs/inch (about 446 kg/m). In some other examples, the printing substrate has a cross direction (CD) tensile stiffness, also measured using an Intron device, that is greater than 15 lbs/inch (about 268 kg/m).

In some other examples, the printing substrate exhibit desirable tear strength and tensile strength. For instance, the printing substrate may have an average machine direction (MD) tear strength that is 8 kgf (kilogram. Force) or higher and an average cross direction (CD) tear strength that is 9 kgf or higher, and may have a machine direction (MD) tensile strength that is 30 kgf or higher and cross direction (CD) tensile strength that is 20 kgf or higher. The Tensile strength represents the resistance of a material to breaking under tension, Tear strength represents the tear resistance. Such measurements are made according to the ASTM D751 "Standard test method for coated fabrics". In some other examples, the printing substrate, when used in a wall covering application, can have a minimum scrubbability resistance of 300 cycles, or maybe more, of linear abrasion. Such measurements are made according to the ASTM F793 "Standard test method for coated fabrics".

In some examples, the printing substrate has an internal bonding strength (or paper delamination energy) that is greater than 150 J/m$^2$ per Scott bond internal bond strength tester. The Scott bond tester measures the delamination energy per Tappi method T569 om-14. This method defines a test that measures the energy required to rapidly delaminate a sheet-type specimen. The "Z" directional rupture is initiated by the impact of a pendulum having both a controlled mass and a controlled velocity that exceeds 6000 times the velocity of tensile strength and other dead-weight testers. The geometry of the apparatus causes the tensile stress to be rotational in nature with negligible shear stress on the specimen.

In some examples, the media according to the present disclosure exhibit a normalized TAAPI brightness of at least 80%. In some other examples, the printable recording media has a normalized TAAPI brightness that is at least 85% (on a scale of 1 to 100). The Tappi brightness is measured using TAPPI Standard T452, "Brightness of pulp, paper, and paperboard (directional reflectance at 457 nm)" by means of Technidyne Brightmeter. Measurements are made at 457 nm blue light at a 45° angle and reported. The brightness of the printable recording media is also desirable even though the weight of the paper is reduced. As used herein, "normalized TAAPI brightness" is the TAAPI brightness (actual or predicted) multiplied by the target basis weight and divided by the basis weight in grams per square meter.

In some examples, the printing substrate disclosed herein have an opacity of at least 80%. In some instances, the opacity is 92% or more. Opacity is an optical property of the paper, and may be determined by a ratio of reflectance measurements. TAPPI opacity (i.e., opacity using 89% reflectance backing) is one opacity value that may be used. TAPPI opacity is 100 times the ratio of reflectance of a sample when backed with a black backing to the reflectance of the sample when backed with a white backing having a known reflectance of 89%. The reflectance measurements may be carried out using a brightness and color meter. Examples of the media according to the present disclosure exhibit opacity of at least 80%. In some other examples, the media according to the present disclosure exhibit an opacity of at least 92.

Figure 2:
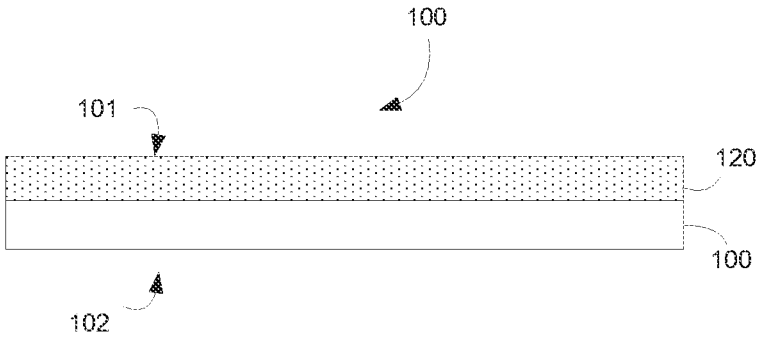

FIG. 1 schematically illustrates an example of the printing substrate (100) of the present disclosure. The printing substrate (100) has an image or printed side (101) and a backside or opposing side (102). The image side (101) of the substrate is the side that includes material layers that will receive, support and protect an image. The backside, or opposing side, (102) is not designed for receiving printing image and is the side that would face and attach to a subject such as a panel, a board and a wall surface in a wall covering application, or even in a sign or banner application having a single image side. As illustrated in FIG. 2, the printing substrate (100) can be considered as a supporting base substrate (100) when an image receiving layer (110) is applied on its image or printed side (101). The image receiving layer (110) is applied, only, on one side of the supporting base substrate (100). In some examples, the printing substrate is a printable media that can be coated with an image receiving layer on the image side (101) of the printing substrate. The opposite side (102) of the printing substrate can be coated or laminated with other materials or laminating/coating such as, for example, a fabric backing (that will improve mechanical strength, feel and look and back adhesion) a flame resistant composition (in order to improve fire resistance) or an adhesion control layer (in order to make the media either permanent sticking or strippable). The printing substrate can be considered as a printing substrate with an image side (101) and a back side (102) (or non-image side).

In some examples, the present disclosure referrer also to a printable recording media that comprises a base substrate containing fibers from wooded resource that have more than 5% of fiber fines with an average length that is less than 0.1 mm; more than about 10 wt % of, at least, a polymeric substance; and particulate inorganic substances having an average particle size between 0.1 and 2.0 μm; and an image receiving layer containing fillers and polymeric substances applied on at least one side of said substrate. In some other examples, the image receiving layer further comprises latex film-forming agents.

The printing substrate contains fibers that are originating form from wooded resource and that have more than 5% of fiber fines which have an average length that is less than 0.1 mm. In some examples, the printing substrate contains fibers, from wooded resource, that have at least 10% of fiber fines with an average length of less than 0.1 mm. Such fiber fines can be selected from any species of hardwood and softwood and/or mixture, or any recycling pulp source.

As used herein, the wording "fines" refers to "fiber fines" or "fiber debris" or to a type of fibers that have an average length that is less than 0.1 mm. Fines are very small fibers and fiber fragments such as fibrils which are thread-like elements unraveled from the wall of native cellulose fiber. Fiber fines types, or fines, can refer to small cellulosic materials that are small enough to pass through a forming fabric. A TAPPI Useful Method defines fines as objects small enough to pass through a conical hole having a minimum diameter of 76 micro-meters. Fiber fines can have two main origins. So-called "primary fines" that consist of parenchyma cells and other small cells that exist within the wood. Kraft pulping releases them as intact, rod-like objects. By contrast "secondary fines" that are produced by refining. An example of secondary fine tends to be ribbon-like.

The printing substrate can contain up to 60% of wood fibril, or fibers from wooded resource, with a weighted average fiber length that is less than about 3.0 mm. The printing substrate can also contain raw base paper formed of fibers that comprises less than 20% of fibers content by dry weight that have a weighted average length between 0.5 and 3.0 mm. In some examples, the printing substrate can contain up to 60% of wood fibril, or fibers from wooded resource, with a weighted average fiber length that is between 0.3 mm to 2.5 mm. In some other examples, the printing substrate contains between 10 and 50% of raw base paper that is formed of fibers with a weighted average length between 0.5 and 2.5 mm. In yet some other examples, the printing substrate contains between 10 and 50% of raw base paper that is formed of fibers with a weighted average length between 0.6 and 1.5 mm.

The printing substrate can contain up to 60% of wood fibril, or fibers from wooded resource, with a weighted average fiber length that is less than about 3.0 mm and more than 5% of fiber fines with an average length less than 0.1 mm. The printing substrate can also contain fibers that comprises less than 20% of fibers content that have an average length between 0.5 and 3.0 mm and have at least 10% of fiber fines with an average length less than 0.1 mm. The weight percentage (wt %) are expressed by total dry weight of the substrate.

As used herein, the term "fiber length" can be interpreted broadly as referring to a weighted average fiber length of a pulp after a refining process. Accordingly, if a fiber is "1" mm in length and weighs "w" mg, then for a given pulp, the weighted average length (L) is Σ (wl)/Σw, or the sum of the products of the weight times the length of each fiber divided by the total weight of the fibers in the specimen.

The printing substrate is made of the dispersed phase or domain that form a composite structure. The dispersed phase of the printing substrate contains fiber fines from wooded resource.

The fibers can be sourced from natural wood species only and can include fibers from recycling pulps (i.e. wood fiber base) (no polymer fiber). In some examples, said fibers are raw base paper. The printing substrate can also be made of any suitable wood or non-wood pulp. Non-limitative examples of suitable pulps include any kind of chemical pulp, mechanical wood pulp, chemically treated ground pulp, CTMP (chemical thermo mechanical pulp), and/or mixtures thereof. In some examples, ground-wood pulp, sulfite pulp, chemically ground pulp, refiner ground pulp, and thermo-mechanical pulp or their mixture can thus be used. In some examples, the raw base contains non-wood pulp such as pulp originating from bamboo, bagasse, kenaf, papyrus, etc. Bleached hardwood chemical pulps may make up the main pulp composition. In some examples, the fibril from wooded source are selected from both natural hardwood and softwood wood or combination of the both species. Pulping process includes wood-free pulping (e.g., kraft chemical pulp and sulfite chemical pulp), or wood pulping (e.g., ground-wood pulp, thermo-mechanical pulp, and/or chemo-thermomechanical pulp), recycled fabric pulp, or combinations thereof.

The printing substrate can contain a synthetic polymeric fiber as a first constituent material and a natural fiber as a second constituent material. The amount of synthetic polymeric fiber can be within a range of about 5 wt % to about 80 wt %; or can be within a range of about 10 wt % to about 30 wt % by weight of total fibers in the second layer. In some examples, the printing substrate contains a synthetic polymeric fiber as a first constituent material and a natural cellulose fiber as a second constituent material, the amount of synthetic polymeric fiber in the fiber composition is within a range of about 5% to about 80% by weight of total fibers.

The printing substrate may comprise a PVC-free synthetic polymeric component that is one of synthetic polymeric fiber. In some examples, the synthetic polymeric fiber can be selected from the group consisting of polyolefins, polyamides, polyesters, polyurethanes, polycarbonates, polyacrylics, a combination of two or more of the fibers, and a mixture of two or more of the fibers. The synthetic polyolefin fiber may include, but is not limited to, polyethylene fiber, polyethylene copolymer fiber, polypropylene fiber, polypropylene copolymer fiber, a combination of two or more of the polyolefin fibers, a combination of any of the polyolefin fibers with another polymeric fiber, mixtures of two or more of the polyolefin fibers, or mixtures of any of the polyolefin fibers with another polymer fiber. In some examples, the fiber composition may include a synthetic cellulosic material including, but not limited to, cellulose diacetate, cellulose triacetate, cellulose propionate, cellulose butyrate, cellulose acetate butyrate and nitrocellulose.

The fiber composition can be used to form a web having the non-woven structure, for example, using paper making equipment. The synthetic polymeric fiber may have an average length within a range of about 1 millimeter (mm) to about 3 mm. This length is comparable to the length of natural cellulose fibers. In some other examples, the synthetic polymeric fiber has diameter within a range of about 10 micrometers or microns (μm) to about 40 μm with an average length within a range of about 2 mm and about 3 mm. The amount of the synthetic polymeric fiber in the second layer depends on the length of the fiber. For example, the use of longer synthetic fibers may allow for improvement in dimensional stability of the supporting substrate with lower amounts of the synthetic fibers being used.

As indicated above, the fiber composition of the supporting substrate may comprise both synthetic fibers and natural fibers. The natural fiber includes natural cellulose fiber from either hardwood species or hardwood species and softwood species. In some examples, a ratio of hardwood fiber to softwood fiber in the substrate layer can be within a range of about 100:0 to about 20:80. The natural cellulose fiber may be processed into various pulps including, but not limited to, wood-free pulp, such as bleached or unbleached Kraft chemical pulp and bleached or unbleached sulfite chemical pulp; wood-containing pulp, such as one or more of ground wood pulp, thermo-mechanical pulp, and chemo-thermo-mechanical pulp; pulp of non-wood natural fiber, such as one or more of bamboo fiber, bagasse fiber, recycled fiber, cotton fiber; a combination of two or more pulps, or a mixture of two or more of pulps. An amount of synthetic polymeric fiber in the second layer fiber composition that further includes natural fiber may be within a range of about 10 wt % to about 80 wt % by weight of total fiber. In some examples, the amount of synthetic polymeric fiber by weight of total fiber in the fiber composition is about 20 wt % to about 70 wt %, or about 30 wt % to about 60 wt %.

In some examples, the printing substrate as described herein might further comprises internal sizing agent (ASA). Such internal sizing agent can be emulsified, for examples, using cationic starch at a 1:4 ratio and can be added at a total dosage rate between 0.2 and 2 wt % of the total fiber weight to the fiber furnish. Additionally, other additives such as optical brightener agents and dyes for color adjustments, retention/drainage aids and biocides for operational efficiency can be added into the fiber furnish.

The printing substrate further comprises particulate inorganic substances, also called fillers or inorganic pigments. Such inorganic substances are present in the printing substrate in the form of particles having an average particle size that is between 0.1 and 2.0 μm (micrometer). The inorganic substances are present, in the dispersed phase of the printing substrate, in the forms of particles and/or flake.

In some examples, the particulate inorganic particles have an average particle size that is less than 2 μm and an L*value (Lightness) that is greater than 70. L*values are measured on Macbeth® TD904 (Macbeth Process measurement).

In some examples, the average particle size or equivalent particle size Distribution D50 is smaller than 1 micrometer (μm) with a Brightness greater than 85% (by ISO 2469 method). The D50 particle size is determined using a Malvern Zetasizer Nano (Malvern Instruments, Malvern, Worcestershire UK) when the sample is diluted at 1:1000 ratio in pure triethyleneglycol divinyl ether. Particle Size Distribution D50 is also known as the median diameter or the medium value of the particle size distribution, it is the value of the particle diameter at 50% in the cumulative distribution. For example, if D50 is 1 μm, then 50% of the particles in the sample are larger than 1 μm, and 50% are smaller than 1 μm. D50 can be used to represent the particle size of group of particles.

In some examples, the particulate inorganic substances or fillers are present in an amount comprised between about 0.1 wt % and 40 wt % by total weight of the printing substrate. In some other examples, the particulate inorganic substances are present in an amount comprised between about 1 wt % and 25 wt % by total weight of the printing substrate. In yet some other examples, the particulate inorganic substances can be present in an amount representing from about 3 wt % to about 15 wt % of the total weight of the printing substrate.

Without being linked by any theory, it is believed that the combination of chemical type, particle size, distribution and loading amount of the particulate inorganic substances help to control the opacity of the printing substrate. In some examples, the combination of these particles characteristic is adjusted to a level which makes the opacity of the substrate greater than 92%. It is believed that the inorganic substances may fill in the void spaces of the fiber network and result in a denser, smoother, brighter and opaque sheet.

Non limited examples of inorganic pigments include: calcium carbonate, kaolin, talc, calcium sulfate, barium sulfate, titanium dioxide, zinc oxide, zinc sulfide, zinc carbonate, satin white, aluminum silicate, diatomite, calcium silicate, magnesium silicate, synthetic amorphous silica, colloidal silica, colloidal alumina, pseudo-boehmite, aluminum hydroxide, alumina, lithopone, zeolite, magnesium carbonate, magnesium hydroxide, and various combinations. In some examples, particulate inorganic substances or pigments are selected from the group consisting of silica, clay, kaolin, calcium carbonate, talc, titanium dioxide, and zeolites. In some other examples, pigments are inorganic pigment particles received in a dry-powder form or in a form of an aqueous suspension, often referred as slurry. Examples of suitable particulate inorganic substances include also precipitated calcium carbonate, ground calcium carbonate, talc, clay (e.g., calcined clay, kaolin clay, or other phyllosilicates), calcium sulfate, titanium dioxide ($TiO_2$) or combinations thereof. The particulate inorganic substances can also be calcined clay, ultra-fine precipitated calcium carbonate, modified calcium carbonate, ground calcium carbonate or combinations thereof.

In some examples, the particulate inorganic substances, present in the printing substrate, are combinations of titanium dioxide and ground calcium carbonate. Precipitated calcium carbonate can be commercially available, for example, under the tradenames Opacarb® A40 and Albacar® (both available from Minerals Technologies Inc.). Ground calcium carbonate is commercially available, for example, under the trade names Omyafil®, Hydrocarb®70 and Omyapaque® (all of which are available from Omya North America). Examples of commercially available filler clays are Kaocal®, EG-44, and B-80 (available from Thiele Kaolin Company). An example of commercially available talc is Finntalc®F03 (available from Mondo Minerals).

In yet some other examples, small amount of organic particles can be selected in order to mix with inorganic particles. Non limited examples of organic substances include: styrene-type plastic pigment, acrylic-type plastic pigment, polyethylene, polymethyl methacrylate, polystyrene and its copolymers, polytetrafluoroethylene (Teflon®) powders, and any combinations. Other examples of organic substances include, but are not limited to, microcapsules, urea resin, melamine resin, or the like. The organic substances can be in a form of solid particles or in a form called "hollow" particles, in other words, where void volumes are present in the particles.

The particulate inorganic substance, by way of illustration and not limitation, can also be Kaocal® calcined clay (particle size distribution of about 83-92% particles finer than 2 μm) (from Thiele Kaolin Company, Sandersville Ga.); Omyajet® B5260 ultrafine precipitated calcium carbonate (average particle size of about 2.4 μm) (from Omya Inc., Florence Vt.); or a mixture of Kaocal® calcined clay and Hydrocarb® 60 fine ground calcium carbonate (average particle size of about 1.5 μm) (from Omya Inc.) wherein the mixture contains, by dry weight, at least about 50%, or at least about 80%, of Kaocal® calcined clay, for example.

The printing substrate further comprises, at least, a polymeric substance with high molecular weight. Said polymeric substance can also be referring to as polymers. The polymers can be natural polymers, i.e. originating from natural resources or can be natural polymers with chemical modification. The polymers can also be originating from synthetic substances and made from monomers that are polymerized in a random, block, and/or grafting manner, and in some instances are cross-linked. By 'high molecular weight', it is meant a weight average molecular weight ($M_w$) that is greater than $1\times10^4$ grams per mole (g/mol). In some examples, the polymeric substances have a molecular weight that is between about $10^4$ and about $10^7$ g/mol.

In some examples, the polymeric substance is present in an amount representing between 10 and 50 wt % of the total weight the printing substrate. In some other examples, the polymeric substance is present in an amount representing between 10 wt % and 30 wt % of the total weight of the printing substrate. In yet some other examples, the polymeric substances are present in an amount representing between 12 wt % and 20 wt % of the total weight of the printing substrate. The weight percentage of the polymeric substance represent the total content of the polymeric substance by total wright of the printing substrate, i.e. the sum of the content of both the first and second polymeric substance when present.

In some examples, the printing substrate comprises a polymeric system containing two or more different polymeric substances, herein arbitrarily called "first polymeric substance" and "second polymeric substance". The second polymeric substance may or may not have the same chemical composition with the first polymeric substance. The first and second polymeric substances can be also considered as polymer particulates.

Without being linked by any theory it is believed that the composite structure of the printing substrate is due to the presence of the polymeric substance. Indeed, in some examples, a first polymeric substance is present in the substrate bonding the micro-domains formed by the particulate inorganic substance and the fibril from wooded resource form the dispersed phase. The second polymeric substance can also be present, in the base substrate, as a continuous phase, forming a layering structure on the outside of the composite of particulate inorganic substance and the fibril from wooded resource. The definition of continuous phase refers a phase domain consisting of a single phase or component in a heterogeneous mixture through which a continuous path to all phase domain boundaries may be drawn without crossing a phase domain boundary. The dispersed phase refers phase domain in a phase-separated mixture that is surrounded by a continuous phase but isolated from all other similar phase domains within the mixture. In some examples, the first and second polymeric substance are polymers which can be film-formed in order to form a continuous phase upon removing of liquid vehicle such as aqueous solvent.

In some examples, the printing substrate comprise a polymeric system having, at least, two different polymeric substances, wherein a first polymeric substance is present in an amount representing between 0.5% and 10% by total weight of the substrate and wherein a second polymeric substance is present in an amount representing between 5% and 40% by total weight of the substrate. In some other examples, the printing substrate comprise a polymeric system having, at least, two different polymeric substances, wherein a first polymeric substance is present in an amount representing between 0.5% and 5% by total weight of the substrate and wherein a second polymeric substance is present in an amount representing between 9% and 30% by total weight of the substrate.

Without being linked by any theory, it is believed that due to use of more than 5% of fiber fines with an average length that is less than 0.1 mm in the fiber structure of the printable substrate, fine or particle retention agent, such as cationic starch, are used in order to prevent felt out of the small particles from the fiber mixing during wet end processing of the paper-making. These retention agents can be chemically large molecules substance or the polymers as being called, but they do not constitute as part or whole components as the polymeric substance descripted in the current invention.

The first and second polymeric substances can be low Tg polymeric latex particulates dispersed in an aqueous solvent. The first and second polymeric substances may have a glass transition temperature (Tg) within a range of about −30° C. to about 50° C. In some examples, the Tg of the first and second polymeric is within a range of about −25° C. to about 30° C., or within a range of about −20° C. to about 20° C.

In some examples, the printing substrate comprises a polymeric system having, at least, two different polymeric substances, wherein both the first and second polymeric substances have a molecular weight that is between about $10^4$ and about $10^7$.

Examples of the first polymeric substance include, but are not limited to, water soluble polymers, such as polyvinyl alcohol, starch derivatives, gelatin, cellulose derivatives, acrylamide polymers; water-dispersible polymers, such as acrylic polymers or copolymers, vinyl acetate latex, polyesters, and styrene-butadiene or acrylonitrile-butadiene copolymer latex; a combination of two or more of the above polymeric substances; or a mixture of two or more of the above polymeric substances.

In some examples, the first polymeric substance is a starch derivative, a polymers or a copolymers of acrylic acid ester and vinyl ester. In some other examples, the first polymeric substance is a polymers or a copolymers of acrylic acid ester and vinyl ester. In some other examples, the first polymeric substance is a polymer of methacrylic acid esters. In yet some other examples, the first polymeric substance is a copolymers of methacrylic acid ester and any of acrylic acid ester, styrene, or divinyl benzene. Examples of the monomers that may be used to form the polymer particulates include methyl methacrylate, t-butylmethacrylate, methyl acrylate, ethyl (meth)acrylate, butyl (meth)acrylate, 2-ethylhexyl (meth)acrylate, benzyl (meth)acrylate, lauryl (meth) acrylate, oleyl (meth)acrylate, palmityl (meth)acrylate, stearyl (meth)acrylate, hydroxyethylacrylate, hydroxyethylmethacrylate, hydroxypropylacrylate, hydroxypropylmethacrylate, ethylene glycol di(meth)acrylate, allyl (meth)acrylate, 1,3-butane-diol di(meth)acrylate, diethylene glycol di(meth)acrylate, and trimethylol propane trimethacrylate. The polymeric substances can be made of acrylate monomers without methyl substitute group, for example or monomers of ethyl acrylate instead of ethyl (methyl) acrylate. Further vinyl ester monomers (e.g., vinyl acetate, vinyl propionate, vinylbenzoate, vinylpivalate, vinyl-2-ethylhexanoate, vinylversatate), vinyl benzene monomers, C1-C12 alkyl acrylamide and methacrylamide monomers (e.g., t-butyl acrylamide, sec-butyl acrylamide, N,N-dimethylacrylamide), and olefin monomers (e.g., polyethylene, polypropylene, and co-polymers) can also be used.

In some examples, the second polymer substance of the printing substrate can be a PVC-free synthetic polymeric film or capable filmed polymers of high molecular weight. By 'high molecular weight', it is meant a weight average molecular weight ($M_w$) that is greater than $1\times10^4$ grams per mole (g/mol). The polymeric film may be made from a non-vinyl chloride polymer including, but not limited to, one or both of homopolymers and copolymers of polyethylene (PE), polypropylene (PP), nylon (polyamides), polystyrene, acrylonitrile butadiene styrene (ABS), polycarbonate, a combination of two or more thereof, or a mixture of two or more thereof. By 'non-vinyl chloride polymer' it is meant that there is no polyvinyl chloride (PVC) existing in the synthetic polymeric film, or that the synthetic polymeric film contains no vinyl chloride chain units (i.e., a PVC-free film), since polyvinyl chloride is known to be harmful to the environment, as mentioned above. The synthetic polymeric component can be a polypropylene film having a weight average molecular weight ($M_W$) within a range of about $2.90\times10^5$ g/mol to about $3.95\times10^5$ g/mol, as measured by gel permeation chromatography (GPC) calibrated with a polystyrene standard. The molecular weight distribution as presented by $M_w/M_n$, where $M_n$ is the number average molecular weight, ranges from about 2.9 to about 4.8 for this example. Moreover in this example, the polypropylene film may be either uni-oriented or biaxially oriented with a density of about 0.85 g/cm$^3$ for amorphous area and of about 0.94 g/cm$^3$ for crystalline area. Also, the polypropylene film may have a melt point that may be within a range of about 140° C. to about 185° C. The polymeric film can be formed in the printing substrate by various methods, such as, for example, but not limited to, melt extrusion, film lamination and cold/hot pressing.

In some examples, the second polymeric substance can be in a liquid state with the polymers being solvent (including water) dispersed or dissolved. It can be present in the substrate as a continuous phase, forming a layering structure on the outside of the composite structure made of inorganic substance and of the fibril from wooded resource. In some examples, the second polymeric substance is a polyvinyl acetate or a polyacrylic emulsion. In some other examples, the second polymeric substance is a polyacrylic emulsion.

The second polymeric substance can be any polymers as listed above for the first polymeric substance or a combination of any them. The second polymeric substance can also be a polymeric substance having a minimum film-forming temperature that ranges from about −40° C. to about 250° C. Examples of second polymeric substance are aqueous-based polymers, including poly(vinyl alcohol), styrene-butadiene emulsions, acrylonitrile-butadiene latex, or combinations thereof. The second polymeric substances may be used with other aqueous-based polymers, such as starch (e.g., oxidized starch, cationized starch, esterified starch, enzymatically denatured starch, etc.), gelatin, casein, soybean protein, cellulose derivatives (e.g., carboxy-methyl cellulose, hydroxyethyl cellulose, etc.), acrylic emulsions, vinyl acetate emulsions, vinylidene chloride emulsions, polyester emulsions, and polyvinylpyrrolidone. Other polymers, which have no minimum film-forming temperature but can form a continuous film on the surface via evaporate the dissolved vehicle, or via the reaction of multiple monomers or oligomers such as epoxy resin can also be used as a second polymeric substance. It is to be understood that the second polymeric substance may or may not have the same chemical structure and properties as the 1st polymeric substance.

The second polymeric substance does not constitute as any polymers commonly used in "surface sizing" operation such dry surface strength agent like starch, tonner adhesion promoter like styrene co-polymers and surfactant/dyes with large molecules.

Examples of polymeric substances include commercial chemicals marketed under the trade name Joncryl® (from BASF), Acronal® (from BASF), FlexBond® (from Rosco) and Sancure® (from Lubrizol). Examples of polymeric substance include also, but are not limited to, cellulose derivatives from the Pearl® serials (by Weyerhaeuser Inc.); cationic starch marketed as Chargemaster® (by Grain Processing Corporation); styrene-butadiene emulsions as marketed as Buna®SE serials (by Lanxess Inc.).

In one aspect, a first polymeric substance can be added to the blend of fibers in the wet end (wet end application). In other word, the polymeric substance can be mixed to the blend of fibers, in the pulp suspension, before the fibers are converted to a paper web or substrate. In some examples, the first polymeric substances are charged cationically or neutrally in order to make it more compatible with wet end fiber mixing. In another aspect, a second polymeric substance can be added using a lamination or extrusion processing if they presented in a state of film, or can be added to the formatted paper roll by film size press, pond size press and/or other surface treatment techniques (size press application). When applied via size press application, i.e. as a surface sizing agent, the second polymeric substance might be a part of a surface sizing solution (or surface treatment composition) and can be therefore mixed with other functional chemical agents in surface sizing processing such as optical brightness agent, UV absorber, and color dye. The second polymeric substance can be in any type of electronic charge (cationic, anionic or neutrally charged).

Thus, the polymeric substance is a polymeric system containing a first polymeric substance and a second polymeric substance, wherein the first polymeric substance can be mixed to the blend of fibers and the second polymeric substance can be applied to the substrate via size press application. In some examples, the first polymeric substance is a cationic polyacrylic polymer and the second polymeric substance is an anionic polyacrylic polymer or a cross-linked PVA. In some other examples, the first polymeric substance is a cationic polyacrylic polymer and is mixed to the blend of fibers and the second polymeric substance is a polyacrylic polymer or a cross-linked PVA and is applied to the substrate via size press application.

When the first polymeric substances are added, they can be part of an internal sizing solution containing internal sizing agent such as alkyl ketene dimer (AKD) and other synthetic polymeric surface size additives such as styrene maleic acid, styrene acrylic acid and styrene acrylic emulsions. In other word, the addition of the first polymeric substances, which does not constitute as the other polymers used in wet end as the functional additives such as retention agent, wet strength agent, and processing aid agents, can take place, on the one hand, before the sheet formation in the paper pulp (internal application).

As mentioned above, the printing substrate of the present disclosure can be considered as a substrate for printable media, meaning therefore that one layer or multiple coating layers, referring as the "image receiving layer" of "ink receiving layer" or "image recording layer" can be deposited on at least one side of the printing substrate. The printing substrate can therefore comprise an image receiving layer that is applied to at least one side of the printing substrate or can comprise two image receiving layers that are applied to both sides of the printing substrate.

The coat weight of the image receiving layer may range, for example, from about 5 gsm to about 50 gsm or may ranges from about 10 gsm to about 20 gsm. Once coated, the image receiving composition dries to form a layer (i.e., the image receiving layer). In some examples, the thickness of the image receiving layer ranges from about 5 microns (μm) to about 40 microns (μm). In some examples, the image receiving layer has a smooth surface with a PPS smoothness that is less than 1.5 micro (μm) or less than 0.8 micro (μm). It is believed that any surface with roughness greater than this range will results an undesirable image quality like mottling.

In some examples, the image receiving layer contains pigment fillers and polymeric binders. The image receiving layer can also contain pigment fillers, polymeric substances and latex film-forming agents. The pigment fillers can be either inorganic and/or organic particulates, either in solids powder form or in a dispersed slurry form. Examples of inorganic pigment filler include, but are not limited to, aluminum silicate, kaolin clay, a calcium carbonate, silica, alumina, boehmite, mica, talc, and combinations or mixtures thereof. The inorganic pigment filler can include clay or a clay mixture. The inorganic pigment filler can include a calcium carbonate or a calcium carbonate mixture. The calcium carbonate may be one or more of ground calcium carbonate (GCC), precipitated calcium carbonate (PCC), modified GCC, and modified PCC. The inorganic pigment fillers may also include a mixture of a calcium carbonate and clay. In some examples, the inorganic pigment fillers include two different calcium carbonates pigments (e.g., GCC and PCC). Examples of organic pigment filler include, but are not limited to, particles, either existing in a dispersed slurry or in a solid powder, of polystyrene and its copolymers, polymethyacrylates and their copolymers, polyacrylates and their copolymers, polyolefins and their copolymers, such as polyethylene and polypropylene, a combination of two or more of the polymers. The pigments, for the image receiving layer (120), may be chosen from silica gel (e.g., Silojet®703C available from Grace Co.), modified (e.g., surface modified, chemically modified, etc.) calcium carbonate (e.g., Omyajet®B6606, C3301, and 5010, all of which are available from Omya, Inc.), precipitated calcium carbonate (e.g., Jetcoat®30 available from Specialty Minerals, Inc.), and combinations thereof. The pigments can be present in an amount ranging, for example, from about 65 wt % to about 85 wt % of the total wt % of the image receiving layer.

The polymeric substance, present in the image receiving layer, can be an aqueous based substance. Examples of suitable polymeric substances include polyvinyl alcohol, styrene-butadiene emulsion, acrylonitrile-butadiene latex, or any combinations. Moreover, in addition to the above substances, other aqueous substances can be added including: starch (including oxidized starch, cationized starch, esterified starch, enzymatically denatured starch and so on), gelatin, casein, soybean protein, cellulose derivatives including carboxy-methyl cellulose, hydroxyethyl cellulose and the like; acrylic emulsion, vinyl acetate emulsion, vinylidene chloride emulsion, polyester emulsion, and polyvinylpyrrolidone. Other examples of suitable polymeric substances include aqueous based substances such as polyvinyl alcohol (examples of which include Kuraray Poval®235, Mowiol® 40-88, and Mowiol® 20-98 available from Kuraray America, Inc.), styrene-butadiene emulsions, acrylonitrile-butadiene latex, and combinations thereof. The amount of the polymeric substance, that is present in the image receiving layer (120), can represent from about 5 to about 40 parts per 100 parts of pigment filler by dry weight; or can represent from about 10 to about 30 parts per 100 parts of pigment filler by dry weight.

The image receiving layer might further contain a latex film-forming agent. It is to be understood that the film-forming agent may be capable of lowering the elastic modulus of polymer particulates (specifically found in latex inks to be printed on the printable medium) and providing temporary plasticization, which promotes polymer chain motion of the polymer particulates during the film forming process. As such, the polymer particulates are more readily able to coalesce, and therefore the film-forming agent can improve the film-forming properties of the polymer particulates. In some examples, the film-forming agents that are part of the image receiving layer, include, citrate compounds, sebacate compounds, ethoxy alcohols, glycol oligomers, glycol polymers, glycol ether, glycerol acetals, anionic, cationic or non-ionic surfactants having a more than 12 carbon backbones (e.g., propylene glycol monoester of C-18 fatty acids and propylene glycol mono oleate (each of which is commercially available under the trade name Loxanol® by BASF Corp), cyclic amides, and combinations thereof. The cyclic amides may be β-lactams (e.g., clavam, oxacephem, cephem, penam, carbapenam, and monobactam), γ-lactams, δ-lactams (e.g., caprolactam and glucarolactam), and combinations thereof. The film-forming agent can be a cyclic amide like lactams such as β-lactam, γ-lactam, and δ-lactam, and mixtures thereof. The latex film-forming agent can also be a γ-lactam. Representative examples of a γ-lactam include N-methyl-2-pyrrolidone, 5-methyl-2-pyrrolidone, and 2-pyrrolidone.

A ratio of the amount of pigment filler to an amount of film-forming agent may be within a range of about 200:1 to about 10:1; or may also be within the range of about 150:1 to about 12:1 or within the range of about 100:1 to about 30:1. In some examples, the image receiving layer comprises pigment filler, an aqueous-based polymeric substance in an amount that ranges from about 5 parts to about 40 parts per 100 parts of the pigment filler by dry weight, and a latex film-forming agent in a ratio of the pigment filler to the latex film-forming agent that is within a range of about 200:1 to about 10:1.

The image receiving layer may further include other additives, e.g., processing aids and property modifiers. Examples of additives that may be incorporated include crosslinking agent, surfactant, defoamer, fixing agent, and/or pH adjuster. The image receiving layer might include from about 1 wt % to about 3 wt % of boric acid as a crosslinking agent, from about 0.5 wt % to about 2 wt % of glycerol, and from about 1 wt % to about 5 wt % of a dye fixing agent (such as, e.g., Locron®P available from Clariant International Ltd). The image receiving layer may also include a defoamer in an amount ranging from about 0.05 wt % to about 0.2 wt % of the total wt % of the image receiving layer. Examples of the defoamer include Foamaster® 1410, 1420, 1430, all of which are available from BASF Corp.

In some examples, the printing substrate may further comprise an adhesive compound that is laminated on the printing substrate. The adhesive compound can be any adhesive which is able to bonder two materials together with adequate strength. The adhesive may be an aqueous latex adhesive that is selected from a wide variety of resin latex. The resin latex of the adhesive may include, but is not limited to, resins formed by polymerization of hydrophobic addition monomers. Examples of hydrophobic addition monomers include, but are not limited to, C1-C12 alkyl acrylate and methacrylate (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmthacrylate), carboxylic acid containing monomers (e.g., acrylic acid, methacrylic acid), vinyl ester monomers (e.g., vinyl acetate, vinyl propionate, vinyl benzoate, vinyl pivalate, vinyl-2-ethylhexanoate, vinyl versatate), vinyl benzene monomer, C1-C12 alkyl acrylamide and methacrylamide (e.g., t-butyl acrylamide, sec-butyl acrylamide, N,N-dimethylacrylamide), crosslinking monomers (e.g., divinyl benzene, ethylene glycol dimethacrylate, bis(acryloylamido)methylene), and combinations thereof. Polymers made from one or both of the polymerization and copolymerization of alkyl acrylate, alkyl methacrylate, vinyl esters, and styrene derivatives also may be used. Representative examples of commercially available adhesive products include, but are not limited to, Acronal® 788 or Acronal® 866 from BASF North America; RayCryl® 347 from Specialty Polymers, Inc., OR, USA; and Flexbond® 325 or Flexbond® 825 from Air Products, Inc., PA, USA.

The printing substrate may further comprise a tie layer applied on the substrate, below the image receiving layer when present. Without being linked by any theory, it is believed that this tie layer is able to provide better adhesion between the printing substrate and a subsequent material layer applied thereon to form a wall covering, including an image receiving layer, as further described below. The tie layer may be a polymeric material with a surface free energy that is higher than the surface free energy of the synthetic polymeric film, for example a surface free energy that is greater than 30 milliNewton per meter (mN/m), as measure at 20° C. In some examples, the polymeric material of the tie layer has a surface free energy that is greater than 35 mN/m, or greater than 38 mN/m, or greater than 40 mN/m. Examples of polymeric material of the tie layer include, but are not limited to, various polyacrylates, various polymethyacrylates, polyethyleneoxide, polyvinyl alcohol, polyethyleneterephthalate, polyamide, polycarbonate, polystyrene, polychlororopene, polyoxyethylene, polystyrene, poly(2-vinyl pyridine), epoxy resins, a combination of two or more of these materials, or a mixture of two or more of these materials. An amount of the tie layer material, applied to the printing substrate, may be within a range of about 0.01 grams per square meter (gsm) to about 5 gsm. In some examples, the amount of the tie layer material is within the range of about 0.1 gsm to about 5 gsm, or about 0.3 gsm to about 4 gsm, or about 0.5 gsm to about 3 gsm.

In some examples, a method for forming a printing substrate such as described herein is described. The printing substrate has a structure comprising fibers from wooded resource that have more than 5% of fiber fines with an average length that is less than 0.1 mm; more than about 10 wt % of, at least, a polymeric substance; and between 0.1 wt % and 40 wt % of particulate inorganic substances having an average particle size between 0.1 and 2.0 μm. Such printing substrate could be an inkjet printing substrate and/or a wall covering medium. Such method encompasses mixing fibers from wooded resource that have more than 5% of fines fibers with an average length that is less than 0.1 mm; more than about 10 wt % of, at least, a polymeric substance; and between 0.1 wt % and 40 wt % of particulate inorganic substances having an average particle size between 0.1 and 2.0 μm; in order to form a printing substrate. The polymeric substance is being applied at the wet end and/or via size press application.

A method for forming a printable recording media is also described herein; such method encompasses providing a printing substrate as described herein, and coating an image receiving layer on at least one side of said substrate.

The polymeric substance can be a polymeric system containing a first polymeric substance and a second polymeric substance. In some examples, the first polymeric substance is being added at the wet end, i.e. directly onto the mixture of fibers in the wet end (wet end application). In other word, the first polymeric substance can be mixed to the blend of fibers, in the pulp suspension, before the fibers are converted to a paper web or substrate. In other some examples, the second polymeric substance is added along with a surface sizing agent to the formatted paper roll by film size press, pond size press and/or other surface treatment techniques (via size press application). When applied via size press application, along with surface sizing agents, the polymeric substance can optionally be part of a sizing solution (both internal and surface sizing composition). The polymeric substance can be a system containing a first polymeric substance and second polymeric substance. Therefore, in one aspect, the first polymeric substance is being applied at the wet end and the second polymeric substance is added along with surface sizing agents to the formatted paper roll. In yet some other examples, the polymeric substance is being applied at the dry end and via size press application.

The printing substrate can be made using a commercial Fourdrinier paper machine. In some examples, a very low consistency (0.5%) pulp stock is jetted from the head-box at a jet-to-wire speed ratio of 1. The water can then be removed either by filtration, pressing or drying in order to continuously form a web of paper base. In one aspect, the initial web is drained of water and passed through large rollers to remove more water and ensure smoothness and uniform thickness of the semi-dry paper web. The semi-dry paper web can be run through steam heated dryers of the paper making machine in order to remove the remaining water and achieved the final moisture target of about 4.5% in the substrate composite web.

The image receiving layer, when present, may be applied to the supporting substrate using any one of a variety of suitable coating methods, such as blade coating, air knife coating, metering rod coating, curtain coating, or another suitable technique. In some examples, blade-coating, metering rod coating or run the coating process at high speed are used. For a double-side coated medium, depending on the set-up of production machine in a mill, both sides of the substrate may be coated during a single manufacture pass, or alternatively, each side may be coated in separate passes. After the coating step, the coated medium can be subjected to a drying process to remove water and other volatile components in the coating layers and substrate. The drying means includes, but are not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a super-calender. The rolls, in a calendar machine, may or may not be heated, and pressure is usually applied to the calendering rolls. In some examples, the image receiving layer are coated onto the base substrate using any method known in the art including size press, slot die, curtain coating, blade coating and Meyer rod. The size presses include puddle-sized press, film-sized press and the like. The puddle-sized press can be configured as having horizontal, vertical, or inclined rollers. The film-sized press can include a metering system, such as gate-roll metering, blade metering, Meyer rod metering, or slot metering. In some examples, a film-sized press with short-dwell blade metering can be used as an application head to apply a coating solution. In some examples, a film-sized press is used to apply the ink receiving layer to a paper substrate. The image receiving layer can be applied to paper substrate off-line or in-line of a paper-making machine.

A calendering process can then be used to achieve the desired gloss or surface smoothness. Calendering is the process of smoothing the surface of the paper by pressing it between nips formed in a pair of rollers. The rollers can be metal hard roll, and soft roll covered with a resilient cover, such as a polymer roll. The resilient-surface roll adapts itself to the contours of the surface of the substrate and presses the opposite side of substrate evenly against the smooth-surface press roll. Any of a number of calendering devices and methods can be used. The calendering device can be a separate super-calendering machine, an on-line calendaring unit, an off-line soft nip calendaring machine, or the like. In some examples, the calendering is carried out at room temperature. In some examples, the calendering is carried out at a temperature ranging from about 50 to about 150° C. (metal roll surface temperature) and, in some other examples, from about 80 to about 110° C. The nip pressure can be any value between about 50 to about 500 KN/cm2.

In some examples, the back-side (or non-image side) of the printable substrate, specifically when used as a wall covering medium, can be pre-applied with an adhesive for adhering to a wall or other surface. In some other examples, the printable substrate can be applied on a wall, as a wall covering, using a commercial available adhesive. Examples of commercial wall-adhering adhesives for wall coverings include, but are not limited to, Pro-880 Premium Clear Strippable, Pro-838 Heavy Duty Clear, Pro-543 Universal, ECO-888 Strippable with Mildew Guard, and Golden Harvest Wheat wallpaper adhesives, all from Roman Decorating Products, IL, USA; Zinsser® Sure Grip®-128 and Zinsser Sure Grip®-132 wallpaper adhesives, both from Rust-Oleum® Corporation, USA; Dynamite® 234, Dynamite° C.-11, Dynamite® DEFENDER wallpaper adhesives, each by Gardner-Gibson, FL, USA; Polycell® Paste the Wall wallpaper adhesive from AkzoNobel Group of Companies, UK; ECOFIX adhesive from Ecofix AB, Sweden; and Metylan and Solvite wallpaper adhesives from Henkel, Germany.

The printable substrate as described herein can be used in a printing method. The printing method encompasses obtaining a printing substrate comprising fibers from wooded resource that have more than 5% of fiber fines with an average length that is less than 0.1 mm; more than about 10 wt % of, at least, a polymeric substance; and between 0.1 wt % and 40 wt % of particulate inorganic substances having an average particle size between 0.1 and 2.0 μm and, then, applying an ink composition onto said printable substrate to form a printed image. Said printed image will have, for examples, enhanced image quality and image permanence. The printable substrate, as disclosed herein, may be used as a wall covering material (e.g., wallpaper) for home or commercial use, for decoration or display. The printable substrate can thus be a printable wall covering medium. The printable substrate is specifically designed to receive any inkjet printable ink, such as, for example, organic solvent-based inkjet inks or aqueous-based inkjet inks. The ink composition forms an image on the image side of the printable substrate or on the image side of wall covering medium.

The ink composition may be deposited, established, or printed on the printable substrate using any suitable printing device. In some examples, the ink composition is applied to the printable substrate via inkjet printing techniques. The ink may be deposited, established, or printed on the medium via continuous inkjet printing or via drop-on-demand inkjet printing, which includes thermal inkjet printing and piezo-electric inkjet printing. Representative examples of printers used to print on the printable substrate or wall covering medium, as defined herein, include, but are not limited to, HP DesignJet printers: L25500, L26500, and L65500; HP Scitex printers: LX600, LX800, LX850, and TurboJet 8600 UV from Hewlett-Packard Company. Representative Inkjet inks used by the above-listed printers include, but are not limited to, HP 791, HP 792, and HP Scitex TJ210. The printers may be used in a standard wall paper profile with a production print mode or a normal print mode. The print mode may vary the ink application within a range of from about 50% to about 250% of each other.

Some examples of inkjet inks that may be deposited, established, or otherwise printed on the printable substrate include pigment-based inkjet inks, dye-based inkjet inks, pigmented latex-based inkjet inks, and UV curable inkjet inks Additionally, the printable substrates are also designed to receive thereon a solid toner or a liquid toner. The solid toner or the liquid toner may include toner particles made, e.g., from a polymeric carrier and one or more pigments. The liquid toner may be an organic solvent-based (e.g., hydrocarbon) liquid toner. The solid toner or the liquid toner may be deposited, established, or otherwise printed on the examples of the printable substrate using, respectively, a suitable dry or liquid press technology, such as a dry toner electrophotographic printing device or a liquid toner electrophotographic printing device.

In some examples, the ink composition is an inkjet ink composition and contains one or more colorants that impart the desired color to the printed message. As used herein, "colorant" includes dyes, pigments, and/or other particulates that may be suspended or dissolved in an ink vehicle. The colorant can be present in the ink composition in an amount required to produce the desired contrast and readability. In some other examples, the ink compositions include pigments as colorants. Pigments that can be used include self-dispersed pigments and non-self-dispersed pigments. Pigments can be organic or inorganic particles as well known in the art. As used herein, "liquid vehicle" is defined to include any liquid composition that is used to carry colorants, including pigments, to a substrate.

In some other examples, the ink composition that is applied to print medium is an ink composition containing latex components. Latex components are, for examples, polymeric latex particulates. Therefore, is some examples, the ink composition contain polymeric latex particulates in an amount representing from about 0.5 wt % to about 15 wt % based on the total weight of the ink composition. The polymeric latex refers herein to a stable dispersion of polymeric micro-particles dispersed in the aqueous vehicle of the ink. The polymeric latex can be natural latex or synthetic latex. Synthetic latexes are usually produced by emulsion polymerization using a variety of initiators, surfactants and monomers. In various examples, the polymeric latex can be cationic, anionic, or amphoteric polymeric latex. In some examples, the latexes are prepared by latex emulsion polymerization and have a weight average molecular weight ranging from about 10,000 Mw to about 5,000,000 Mw. The polymeric latex can be selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers and acrylonitrile-butadiene polymers or copolymers. The latex components are on the form of a polymeric latex liquid suspension. Such polymeric latex liquid suspension can contain a liquid (such as water and/or other liquids) and polymeric latex particulates having a size ranging from about 20 nm to about 500 nm or ranging from about 100 nm to about 300 nm.

EXAMPLES

Example A—Printable Substrate

Example 1 (Exp. 1)

A printable substrate is fabricated using 100 parts of a fiber mixture that includes about 22 parts of softwood bleached kraft pulp, 65 parts of hardwood bleached kraft pulp and 13 parts recycled fibers and machine broke, in water. Both softwood and hardwood kraft pulps are refined separately using a double disc refiner and mixed with other fibers in the ratio mentioned above. About 20% to about 25% fines having an average length of less than 0.1 mm are included in the substrate. A cationic corn starch (Charge-master® available from Grain Processing Corporation) with a small quantities of cationically charged substitute groups (in a rate of about 1.5-5.5 cationic group per 100 glucose unite) is used as the fines retention control agents. The amount of this cationic starch is ranged between 0.3 and 0.8% by weight of the printing substrate. Even through this starch has a high molecules weight of about 750,000 to 2,500,000; another polymeric emulsion (first polymeric substance) with a cationic polyacrylic structure is added at a dosage rate based on the weight substrate, in a range of about 3 to about 4.5% of printable substrate is added in the fiber finish, by pre-mixing with fiber pulp and then adding into the furnish to further increase the strength of the paper. A mixture of inorganic particles are added into the fiber furnish to achieve about 13% target ash content (measured inline) (13 wt % of inorganic particles with a particles sizes of about 0.3 to about 0.5 μm). The inorganic particles include grounded calcium carbonate powder and $TiO_2$ powder in a weight ratio of 10 parts to 1.5 parts. Such particles are added in order to enhance opacity, brightness and whiteness. The printable media substrate of Example 1 has a basis weight of 155 gsm. The printable media substrate is made using a commercial Fourdrinier paper machine. A very low consistency (0.5%) pulp stock is jetted from the head-box at a jet-to-wire speed ratio of 1, water is then removed by filtration, pressing and drying in order to continuously form a web of paper base. The initial web is drained of water and passed through large rollers to remove more water and ensure smoothness and uniform thickness of the semi-dry paper web. The semi-dry paper web is then run through steam heated dryers of the paper making machine in order to remove the remaining water and achieved the final moisture target of about 4.5% in the substrate composite web.

After the composite web is dried, the web is brought to surface size station with a puddle or rod metering size press machine. A surface size solution comprising a second polymeric substance (a polymeric substance anionic polyacrylic chemistry based latex) is applied on the surface of substrate web and dried. The amount of polymeric substance (i.e. the amount of the first and second polymeric substance) applied per total weight of the substrate is listed in Table 1.

TABLE 1

| | Substrate sample ID | | | | | |
|---|---|---|---|---|---|---|
| | Exp. 1-1 (comparison) | Exp. 1-2 (comparison) | Exp. 1-3 | Exp. 1-4 | Exp. 1-5 | Exp. 1-6 (comparison) |
| Chemistry of 1st polymeric substance | Cationic polyacrylic | Cationic polyacrylic | Cationic polyacrylic | Cationic polyacrylic | Cationic polyacrylic | Cationic polyacrylic |
| Chemistry of 2nd polymeric substance | Anionic polyacrylic | Anionic polyacrylic | Anionic polyacrylic | Anionic polyacrylic | Cross-linked PVA | Anionic polyacrylic |
| Total wt % of Polymeric substance | 3.5 wt % | 6 wt % | 12 wt % | 18 wt % | 14 wt % | 30.2 wt % |

Comparative Example 2 (Exp. 2)

A printable media substrate is fabricated using 100 parts of a fiber mixture that includes about 22 parts of softwood bleached kraft pulp, 65 parts of hardwood bleached kraft pulp and 13 parts recycled fibers and machine broke, together in water. Both softwood and hardwood kraft pulps are refined separately using a double disc refiner and mixed with other fibers in the ratio mentioned above. About 20% to about 25% fiber fines, with an average length less than 0.1 mm, are included in the substrate. A cationic corn starch, Chargemaster®, (available from Grain Processing Corporation) with a small quantities of cationically charged substitute groups in a rate of about 1.5-5.5 cationic group per 100 glucose unite is used as fines retention control agents. The amount of this cationic starch is ranged between 0.3 and 0.8% by weight of printing substrate. Even through this starch has a high molecules weight about 750,000 to 2,500,000, another polymeric emulsion (first polymeric substance) with a cationic polyacrylic structure is added at a dosage rate based on the weight substrate, in a range of 3-4.5% of printable substrate is added in the fiber finish, by pre-mixing with fiber pulp and then adding into the furnish to further increase the strength of the paper.

A mixture of inorganic particles are added into the fiber furnish to achieve about 11.5% target ash content (measured inline) (11.5 wt % of inorganic particles with a particles sizes of about 0.3 to about 0.5 μm). The inorganic particles include grounded calcium carbonate powder and $TiO_2$ powder in a weight ratio of 10 parts to 1.5 parts. The printable media substrate of Example 2 has a basis weight of 155 gsm. The manufacture procedure in the wet end is the same as described in the example 1. After the composite web is dried, the web is brought to surface size station with a puddle or rod metering size press machine. A commonly used "surface size solution" comprising corn starch (Panford®280 as supplied by Penford Inc.), color dye and optical brightness agent are applied on the web surface in an amount of about 0.2 to about 0.5% by weight of printable substrate. The surface sizing composition of the comparative example 2 does not contain any second polymeric substance.

Comparative Example 3 (Exp. 3)

Exp. 3 has the same wet furnish composite as examples 1 and is made under the same manufacture condition. However, the media of Example 3 does not have any polymeric substance that is applied during wet-end and/or surface sizing; rather, an usual ethylated corn-starch is used as surface sizing agent in an amount of about 3 gsm.

Comparative Example 4 (Exp. 4)

Exp. 4 has the similar wet furnish composite as example 1 and is made under the same manufacture condition. However, the media of Example 4 has a higher concentration of larger particle, it contains about 5 wt % of inorganic particles having an average particles size in the range of about 2 to 4.5 μm.

Example 5 (Exp. 5)

The printable media substrate of Example 5 has a basis weight of 155 gsm and has the similar wet furnish composite as Example 1 and is made under the same manufacture condition. However, the media of Example 5 has 0.5 wt % of $TiO_2$. The final opacity of the media of example 5 is 92%.

Comparative Example 6 (Exp. 6)

The printable media substrate of Example 6 has a similar pulping composition as Example 1 (100 parts of a fiber mixture that included about 22 parts softwood bleached kraft pulp, 65 parts hardwood bleached kraft pulp, and 13 parts recycled fibers and machine broke, together in water). Less than 5% fiber fines, with an average length less than 0.1 mm are included in the substrate. A cationic corn starch, (Chargemaster® available from Grain Processing Corporation) with small quantities of cationically charged substitute groups in a rate of about 1.5-5.5 cationic group per 100 glucose unite is used as fines retention control agents. The amount of this cationic starch based surface size is of about 3 gsm. A mixture of inorganic particles are added into the fiber furnish to achieve about 11.5% target ash content (measured inline) (13 wt % of inorganic particles with a particles sizes of about 0.3 to about 0.5 μm). The inorganic particles include grounded calcium carbonate powder and TiO2 powder in a weight ratio of 10 parts to 1.5 parts. The printable media substrate of Example 6 has a basis weight of 155 gsm. The manufacture procedure in the wet end is the same as described in Example 1. After composite web is dried, the web is brought to surface size station with a puddle or rod metering size press machine. A surface size solution is loaded with an anionic polyacrylic latex in an amount of 15% is applied on the surface of substrate web and dried.

Example B—the Printable Recording Media

The substrate obtained in Examples 1-6 are coated with an image receiving layer. The formulation of the image receiving layer is illustrated in Table 2 below. The image receiving layer is prepared in a high shear mixer. The final solids content after mixing is 52% and the viscosity is 180 centipoise (cps) as measured by a Brookfield viscometer at 100 rpm. The image receiving layer is applied to the substrate samples at a coat weight of 20 gsm with a multi-structured coating. A production coater equipped with Mayer rod application station is used to coat the coating layers with wet-on-dry sequence. Drying is accomplished in an 8 meter hot air drying channel with a total coating speed of 200 meters per minute. The obtained printable recording media A to F are evaluated for their printing image quality and printing image durability.

The printable recording media I to VI are printed using an HP DesignJet L26500 printer equipped with HP 792 latex inks, using a six color process at 110° C. and at a speed of 100 square feet per hour (a 10 pass bidirectional color profile). An image was created on each Sample with an equal percentage of each of the six ink colors.

TABLE 2

Image receiving layer-formulation

| Ingredient | Suppliers | Amount (Parts) |
|---|---|---|
| Hydrocarb ® 60 | Calcium carbonate pigment fillers from Omya NA | 80 |
| Hydrocarb ® 90 | Calcium carbonate pigment fillers from Omya NA | 20 |
| Acronal ® 866 | styrene-acrylic substance from BASF Corporation | 15 |
| 2-pyrrolidinone | Film forming agent from Aldrich Inc. | 1 |
| Byk-Dynwet ® 800 | silicone-free wetting agent from BYK Inc. | 0.5 |
| BYK ®-024 | VOC-free silicone defoamer from BYK Inc. | 0.2 |

Example C—Substrate and Printable Recording Media Performances

Mechanical Strength Performances—The mechanical strength (mechanical properties) of the un-printed media substrates 1 to 6 is measured in terms of tear strength, tensile strength and surface strength under friction. Tear strength and tensile strength are measured in accordance with ASTM (American Society for Testing and Materials) D751. This test method measures the maximum force required to break a sample when the sample is pulled in opposite directions. In accordance with this test method, the Sample and the Comparative Sample are cut into pieces and are clamped into jaws and are pulled until they broke. The results are reported in gram-force (gf) and/or (lb/inch). The ASTM Scrub Strength is measured according to ASTM F793 (Scrub test) (as detailed below). Table 3 illustrates the mechanical properties results (in the machine direction (MD) and the cross direction (CD)) of the un-printed media substrate Samples 1 to 6. Such results demonstrate that un-printed substrate containing polymeric substance have superior mechanical strength over the sample that does not contain polymeric substances.

TABLE 3

| Sample ID | Tear Strength (MD) | Tensile Strength (MD, CD) | Scrub Strength Scores on un-printed substrate |
|---|---|---|---|
| Example 1-1 (comp.) | 180 gf | 30, 25 lb/inch | 2 |
| Example 1-2 (comp.) | 270 gf | 40, 30 lb/inch | 2 |
| Example 1-3 | 500 gf | 60, 40 lb/inch | 5 |
| Example 1-4 | 470 gf | 60, 40 lb/inch | 5 |
| Example 1-5 | 380 gf | 60, 35 lb/inch | 3+ |
| Example 1-6 (comp.) | 720 gf | 70, 45 lb/inch | 5 |
| Example 2 (comp.) | 250 gf | 30, 35 lb/inch | 2 |
| Example 3 (comp.) | 120 gf | 30, 15 lb/inch | 1 |
| Example 6 (comp.) | 550 gf | 65, 50 lb/inch | 5 |

Scrub Performances—The scrub performances of the printed media substrates and of the comparative printed media substrates are measured with scrubbability tests. The printed media are evaluated for their wet surface strength (Scrub test) and substrate stiffness (Tabber test) (wet and dry surface strength of substrate). The results of these tests are expressed in Table 4 below. The media substrates are evaluated also for their "stiffness" (or rigidity). Such parameter measures to which extend the media resists deformation in response to an applied force.

The scrubbability test (Scrub Strength test), in accordance with ASTM F793, is performed by exposing the Samples to a nylon bristle brush and detergent solution (made in accordance with "Note 1" under section 7.4.1 of ASTM F793) in a BYK Abrasion Tester (from BYK-Gardner USA, Columbus, Md.) with a linear, back-and-forth action, attempting to wear down the image side of the Samples (100 cycles of a nylon brush over a printed surface, wet with trisodium-phosphate based cleaning solution). After rinsing and drying, the samples are evaluated. The dry Tabber test is done in order to evaluate surface damage of a print sample under dry condition. For this test, a printed sample is placed in a "crock-meter", equipped with crock-cloth covered tip and loaded with a specified weight (5 kg). The tool is turned on and crock cloth tip moves in a linear motion back and forth for five cycles. Then, the crock cloth is removed and the sample is ranked visually according to ASTM F793. Each testing item is given a rating score according to a 1 to 5 scale, wherein 1 means the worst performance and 5 represents the best performance (according to the guidelines listed in 7.7.2 and visual rating criteria listed in 7.4.2 of ASTM F793). Any "visual difference" and damage in the printed surface have a score equal or below 3. If there is no difference (no damage or very slightly damage) the score is 4 or 5.

TABLE 4

| Substrate sample ID | Exp. 1-1 (comp.) | Exp. 1-2 (comp.) | Exp. 1-3 | Exp. 1-4 | Exp. 1-5 | Exp. 1-6 (comp.) | Exp. 2 (comp.) | Exp. 3 (comp.) | Exp. 6 (comp.) |
|---|---|---|---|---|---|---|---|---|---|
| Scrub Strength Scores | 1 | 1 | 5 | 5 | 3+ | 5 | 2 | 1 | 5 |
| Dry Tabber Scores | 1 | 4 | 5 | 5 | 5 | 6 | 4 | 1 | 5 |
| Stiffness | 2 | 2 | 5 | 5 | 4 | 1 | 3 | 2 | 5 |

The printed media and printed comparative media are evaluated for their print quality, image durability and their stain resistance. Image quality is evaluated using both numeric measurement method (72 color gamut and gloss) and visual evaluation method. The results are expressed in the Table 5 below.

The testing method involves printing standardized diagnostic images onto the said printing media, then numerically measuring gamut/color saturation, ink bleed, coalescence, text clarity, ink dry time, and gloss level, using spectrophotometer (such as the X-Rite i1/i0) and single-angle glossmeter (such as the BYK Gloss-meter). Visual evaluations are done in a light box under standard lighting conditions, such as D65 (6500K), with the image at a known distance & viewing angle. The attributes under visual evaluation are color gamut, area fill uniformity for defects such as coalescence, mottle grain. Each testing item is given a rating score according to a 1 to 5 scale, wherein 1 means the worst performance and 5 represents the best performance. The stain resistance is evaluated according to the ASTM F793 method (section 7.5.1) that directs to lay specimens horizontally with decorative surface upwards. 12 reagents are placed onto the surface, covered with a watch glass, and then removed after 24 hrs. Each spot is visually rated. The "stain rating handbook" is used to facilitate the visual ranking, thereby defining a 1-5 ranking system in which the rating from 1 to 3.5 are considered a "FAIL", and from 4 to 5 are considered to be a "PASS". The image durability is by performing with the scrub resistance test as in ASTM F793 as mentioned above. The media samples are also evaluated for their opacity. The samples are then given a rating score according to a 1 to 5 scale (wherein 1 means the worst performance and 5 represents the best performance). The opacity is tested using TAPPI test method T425 (with reflectance measurements). Higher opacity values indicate that it is more difficult to see through the sheet of paper.

TABLE 5

| Substrate samples | 72 Color Gamut | Gloss 75 at degree | Coalescence | Bleed | Visual IQ | Image durability | Stain Resistance | Opacity |
|---|---|---|---|---|---|---|---|---|
| Example 1-3 | 410,000 | 17 | 5 | 4 | 5 | 5 | 5 | Good |
| Example 2 (comp.) | 330,000 | 10 | 5 | 5 | 3 | 2 | 1 | Good |
| Example 3 (comp.) | 275,000 | 12 | 5 | 5 | 3 | 1 | 1 | Good |
| Example 4 (comp.) | 350,000 | 15 | 3 | 3 | 2 | 5 | 4 | Good |
| Example 5 | 420,000 | 12 | 5 | 5 | 5 | 5 | 5 | Excellent |
| Example 6 (comp.) | 395000 | 15 | 3 | 4 | 4 | 5 | 5 | Average |

The printed media and the printed comparative media are evaluated for their Surface smoothness and their image quality. The print quality is a visual evaluation of the coalescence, dry time and bleed, with 1 being the worst rank and 5 being the best rank. The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit), the smaller the unit is better the smoothness is. The results are expressed in Table 6 below.

TABLE 6

| Substrate sample | Surface smoothness (Sheffield) | Total Image quality |
|---|---|---|
| Example 1-4 | 85 | 5 |
| Example 4 (Comp.) | 103 | 2-3 |

The printed media and the comparative media are evaluated for their opacity, the ink absorption, Stiffness and caliper. The results are expressed in Table 7 below. The ink absorption is measured by Bristow wheel equipment (also called the Paprican Dynamic Sorption Tester, model LBA92, manufactured by Op Test Equipment Inc.). The test is designed to measure the amount of ink fluid absorbed onto the surface of media and calculated using the following formula: Ink absorption rate=ink volume/(trace length×trace width×contact time). Ideally, the ink absorption rate should be as fast as possible in order to dry quickly but while still have good image quality. The absorption rate is measured in $ml/m^2 \times sec^{1/2}$. The Caliper measurement is done according to TAPPI T411 with a caliper tool that measures overall thickness of the material. Such measurements are reported in reports in units of 'mils' or 'μm'. The opacity is tested using TAPPI test method T425 and is expressed in %, the higher the number is the better the opacity is. A media with a percentage of opacity below 95% will have a poor Hiding ability (ability to hide wall defect for example). A media with a percentage of opacity above 95% will have good Hiding ability.

TABLE 7

| Substrate sample | Caliper | Opacity | Stiffness (MD, CD) | ink absorption rate ($mL/m^2/sec$) |
|---|---|---|---|---|
| Example 1-4 | 7.6 mil | 96% | 14, 7.5 | 46 |
| Example 1-6 (Comp.) | 7.8 mil | 96% | 27, 14 | 9 |
| Example 5 | 6.3 mil | 98% | 9.5, 6 | 47 |
| Example 6 (Comp.) | 7.6 mil | 95% | 14, 6 | 33 |

The invention claimed is:

1. A printing substrate comprising:

a. fibers from wooded resource that have more than 5% of fiber fines with an average length that is less than 0.1 mm;

b. more than about 10 wt % of, at least, a polymeric substance;

c. and between 0.1 wt % and 40 wt % of particulate inorganic substances having an average particle size between 0.1 and 2.0 μm, wherein the polymeric substance is a polymeric system containing, at least, a first polymeric substance that is a cationic polyacrylic polymer and a second polymeric substance that is an anionic polyacrylic or a cross-linked PVA.

2. The printing substrate of claim 1 wherein the fibers have at least than 10% of fiber fines with an average length of less than 0.1 mm.

3. The printing substrate of claim 1 wherein the fibers contain less than 20% of fibers content that have an average length between 0.5 and 3.0 mm and have at least 10% of fiber fines with an average length less than 0.1 mm.

4. The printing substrate of claim 1 wherein the particulate inorganic substances, having a size of between 0.1 and 2.0 μm, are present in an amount comprised between about 1 wt % and 25 wt % by total weight of the printing substrate.

5. The printing substrate of claim 1 wherein the particulate inorganic substances are combinations of titanium dioxide and ground calcium carbonate.

6. The printing substrate of claim 1 wherein the polymeric substance is present in an amount representing between 10 and 30 wt % of the total weight of the printing substrate.

7. The printing substrate of claim 1 wherein the polymeric substance has a molecular weight that is between about $10^4$ and about $10^7$ g/mol.

8. The printing substrate of claim 1 wherein the first polymeric substance is present in an amount representing between 0.5% and 5% by total weight of the printing substrate and the second polymeric substance is present in an amount representing between 9% and 30% by total weight of the printing substrate.

9. The printing substrate of claim 1 wherein the first polymeric substance is mixed into the blend of fibers and the second polymeric substance is applied to the substrate via size press application.

10. A printing substrate comprising:

a. fibers from wooded resource that have more than 5% of fiber fines with an average length that is less than 0.1 mm;

b. more than about 10 wt % of, at least, a polymeric substance;

c. and between 0.1 wt % and 40 wt % of particulate inorganic substances having an average particle size between 0.1 and 2.0 μm, wherein the polymeric substance is a polymeric system containing a first polymeric substance and a second polymeric substance, wherein the first polymeric substance is mixed into the blend of fibers and the second polymeric substance is applied to the substrate via size press application.

11. The printing substrate of claim 10 wherein the fibers have at least than 10% of fiber fines with an average length of less than 0.1 mm.

12. The printing substrate of claim 10 wherein the fibers contain less than 20% of fibers content that have an average length between 0.5 and 3.0 mm and have at least 10% of fiber fines with an average length less than 0.1 mm.

13. The printing substrate of claim 10 wherein the particulate inorganic substances, having a size of between 0.1 and 2.0 μm, are present in an amount comprised between about 1 wt % and 25 wt % by total weight of the printing substrate.

14. The printing substrate of claim 10 wherein the particulate inorganic substances are combinations of titanium dioxide and ground calcium carbonate.

15. The printing substrate of claim 10 wherein the polymeric substance is present in an amount representing between 10 and 30 wt % of the total weight of the printing substrate.

16. The printing substrate of claim 10 wherein the polymeric substance has a molecular weight that is between about $10^4$ and about $10^7$ g/mol.

17. The printing substrate of claim 10 wherein the first polymeric substance is present in an amount representing between 0.5% and 5% by total weight of the printing substrate and the second polymeric substance is present in an amount representing between 9% and 30% by total weight of the printing substrate.

18. The printing substrate of claim 10 wherein the first polymeric substance is a starch derivative, polymers or copolymers of acrylic acid ester and vinyl ester.

19. The printing substrate of claim 10 wherein the second polymeric substance is a polyvinyl acetate or a polyacrylic emulsion.

20. The printing substrate of claim 10 wherein the first polymeric substance is a cationic polyacrylic polymer and the second polymeric substance is an anionic polyacrylic or a cross-linked PVA.

* * * * *